United States Patent [19]

Neuberg et al.

[11] Patent Number: 4,615,911

[45] Date of Patent: Oct. 7, 1986

[54] METHOD OF USING POWDERS TO CURE SOLVENT FREE INKS

[75] Inventors: William B. Neuberg, Perrineville; John J. Aclin, Bricktown, both of N.J.

[73] Assignee: Shamrock Chemicals Corporation, Newark, N.J.

[21] Appl. No.: 640,326

[22] Filed: Aug. 13, 1984

[51] Int. Cl.[4] ..... B05D 1/40

[52] U.S. Cl. ..... 427/197; 427/194; 427/366; 427/398.2

[58] Field of Search ..... 427/197, 194, 366, 398.2; 118/60, 67, 68, 69, 106

[56] References Cited

U.S. PATENT DOCUMENTS

| | | | |
|---|---|---|---|
| 3,067,469 | 12/1962 | Yarrison | 427/194 X |
| 3,440,076 | 4/1969 | Vaurio | 427/197 X |
| 3,911,160 | 10/1975 | Neuberg | 427/197 X |
| 3,936,254 | 2/1976 | Sawada et al. | 118/106 X |
| 4,243,700 | 1/1981 | Piazza | 427/197 X |

*Primary Examiner*—Shrive P. Beck

*Attorney, Agent, or Firm*—Brumbaugh, Graves, Donohue & Raymond

[57] ABSTRACT

An improved process for curing solvent free inks using resin powder makes use of a caulstock laminate which is applied against a printed surface bearing ink and resin powder. The printed material and the caulstock are heated, pressed together and then cooled.

11 Claims, 2 Drawing Figures

METHOD OF USING POWDERS TO CURE SOLVENT FREE INKS

BACKGROUND OF THE INVENTION

Prior U.S. Pat. No. 3,911,160, which was granted to co-inventor William B. Neuberg, describes a method for curing solvent free inks by the application of a powder resin to a freshly printed surface. The printed surface then cured, such as by passing it through a heating apparatus, wherein the resin melts, curing the ink.

The prior patent suggests mechanically leveling the printed surface following curing to produce a high gloss. Applicants have found that in some instances such mechanical leveling causes a smearing of the ink and molten powder resin coating, particularly on printed surfaces using half-tone dots. Such mechanical leveling can cause a smearing of the half-tone dots to an oval or teardrop shape without producing a uniform coating surface.

The present invention is an improved method of using resin powders to cure solvent free inks and provides a process wherein high gloss can be achieved with a half-tone printing process and without the use of a mechanically leveling apparatus that would produce smearing of the half-tone dots. The process permits replication of the high gloss or matte caulstock, or other release surfaces described herein, and eliminates the problem of smearing of the molten powder resin coating or half-tone dots experienced in the earlier patent.

SUMMARY OF THE INVENTION

In accordance with the present invention the process for curing solvent free ink wherein resin powder is applied to a printed surface on a web and cured, is improved by applying a caulstock laminate having a release agent to the powdered, printed surface of the web and wherein the web and the caulstock are passed together over a first, heated roller and pressed between the first roller and a second roller. Thereafter the web and the caulstock are passed over at least a third cooled roller and the caulstock is peeled from the web.

The caulstock may have an aluminum foil surface which is applied against the printed surface or a thermoset resin surface which is applied against the printed surface. The second roller is preferably heated and there may be provided additional cooling rollers to cool the web and the caulstock prior to separation. The caulstock laminate can be re-used by winding on a take-up spool, or by using an endless caulstock laminate which is returned to be reapplied to the web. The process can be used to simultaneously cure printing on both sides of the web by applying a second caulstock to the reverse side of the printed web.

In accordance with the invention there is provided the product of the process and also an apparatus for carrying out the process.

For a better understanding of the present invention together with other and further objects, reference is made to the following description, taken in conjunction with the accompanying drawings and its scope will be pointed out in the appended claims.

DESCRIPTION OF THE INVENTION

Figure 1:
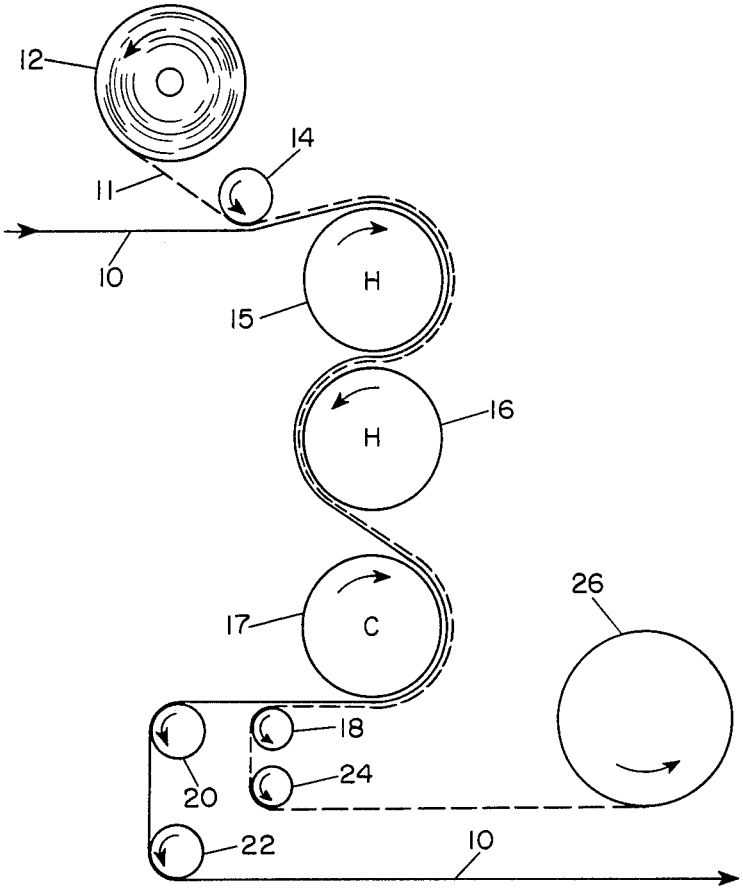
FIG. 1 is a diagram illustrating a printed web undergoing the process of the present invention and the apparatus for carrying out the process of printing on the upper surface of the web only.

The first embodiment of the present invention will be described with reference to the simplified apparatus and process drawing of FIG. 1. In FIG. 1 there is shown a simplified side view of an apparatus for processing a web 10 with printing on its upper surface to which there has been applied a resin powder in accordance with the techniques of the invention described in the referenced prior patent to co-inventor Neuberg. The web 10 consists of a paper, polymeric film, or foil material on which, by conventional printing processes, there has been deposited a solvent-free ink, the ink being one of the types listed in the referenced Neuberg patent. Following application of ink, the upper printed surface of web 10 has applied thereto a resin powder of one of the types listed in the referenced Neuberg patent, and excess powder has been removed from the surfaced by means of an air knife, as described in the prior Neuberg patent. In a preferred embodiment of the invention, the resin and ink have not been cured by heating or other means, but the invention may also be used in cases where the surface has been pre-cured.

As shown in FIG. 1 the upper printed surface of web 10 is mated with a caulstock 11, which is shown as a dotted line for clarity in the illustration. Caulstock 11 is provided from a feed spool 12 and mated with web 10 at idler roller 14. The combined caulstock and web are thereafter received by a driven heated roller 15.

Caulstock 11 consists of a laminate of aluminum foil approximately 0.3 millimeters thick which is laminated to paper, such as 60 pound lithostock. The foil surface may be either high gloss or matt, according to the desired finished of the printed surface on web 10. Caulstock of the required characteristics can be obtained commercially, such as from Gum Products Company. The foil surface of the caulstock is not treated with the usually provided stearic acid release agent, but it is treated with a release agent, wherein the fusion or boiling temperature of the release agent is higher than the operating temperature of the invention. The foil surface is preferably treated with silicone or polyvinyl alcohol based release agents. Other suitable release agents such as lecithin may be employed which permit release of the fused powder caulstock. Experiments have indicated that a release agent marketed under the trade name "Frekote Exitt" mold release which was sprayed onto the foil is suitable for the process. As an alternate to the use of a foil laminate, other casting papers or films and laminated webs such as a thermoset resin, coated paper or polymeric film caulstock can be used for the process of the invention. The surface of all systems may require the application of an approved release media. Certain thermoset silicone resin papers or casting papers may be used without application of external release media.

As illustrated in FIG. 1, the combined web 10 and caulstock 11 are received around heated roller 15, which is driven at a speed to takeup the material as it comes from the press. The material is heated as it passes around roller 15 to achieve curing of the ink and powder as described in the prior Neuberg patent. The web and caulstock then passes onto a second roller 16, which in the preferred embodiment is also heated. Roller 16 bears against roller 15 with the web and caulstock between to effectively nip the printed surface against the caulstock while the resin is in a heated condition. For this purpose the clearance between the rollers should be 0.005 inches for a web and caulstock having a combined thickness of 0.0055 inches. The inventors believe that this process causes a continuous resin bead to be maintained at the pressure point to yield a result which provides a continuous resin film over the printed surface. In the case of half-tone printing the resin film must be continuous to provide a smooth matt or high gloss finish, as contrasted to a dull finish which results from merely heat curing a half-tone printed surface according to the process of the prior patent. When the prior process is applied to half-tones, the space between half-tone dots has no resin finish, and therefore the overall surface appears to have a dull rough texture.

The rollers 15 and 16 are heated above the curing temperature of the resin, but not to a level which would cause discoloration of the paper. A temperature of 275° to 300° F. has been found suitable, but it is expected that temperatures above 400° F. would cause paper discoloration at slow line speed. The temperature level of the rollers depends on the number of rollers which are heated and the speed of the web movement. At high speed it would be appropriate to either use one or more of the following: a preheater oven, more rollers, larger diameter rollers or higher roll temperatures to maintain sufficient roller contact time to heat the resin to curing temperature prior to nipping the surface between the heated rollers. It is appropriate that both rollers 15 and 16 be mechanically driven in coordination with the press speed. However, if the copy being produced does not require a nip pressure to achieve leveling of the powderset material, the heating rolls may be free idler rolls.

From roller 16 the combined web and caulstock passes onto cooling roll or rollers, in the case of FIG. 1 a single roller 17. The cooling roller can be water cooled with water at temperature of approximately 55° F., and a sufficient amount of cooling contact should be provided to cool the web and caulstock to 90° F. prior to separation.

In the apparatus of FIG. 1 the caulstock is separated from the web at idler roller 18, and is thereafter passed over roller 24 and taken-up on spool 26. The printed and cured web passes over rollers 20 and 22 and thereafter is provided to other processing, such as a takeup spool or cutting apparatus.

Figure 2:
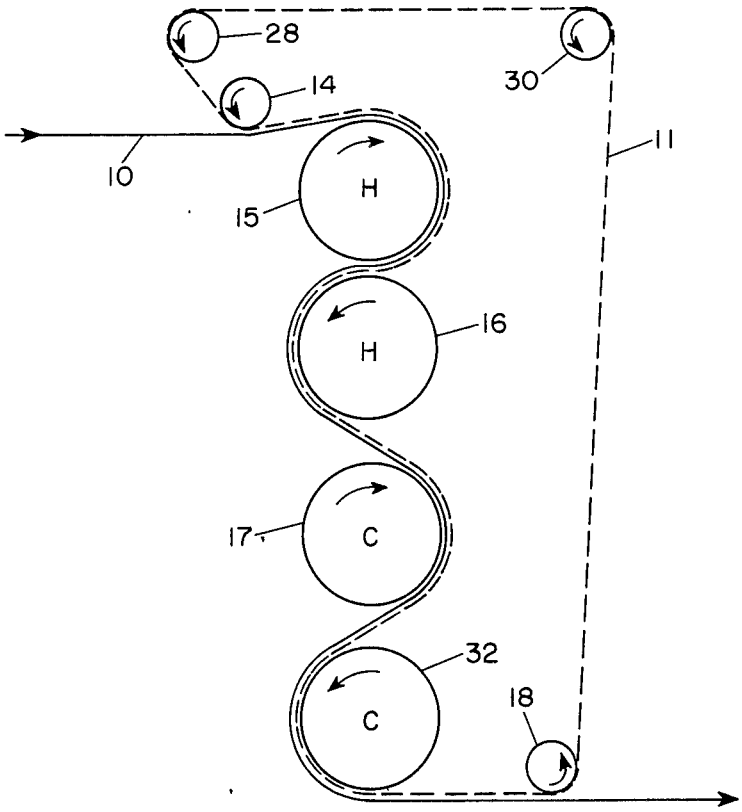
FIG. 2 is a simplified drawing illustrating another embodiment of the apparatus for carrying out the present invention.

FIG. 2 illustrates a minor variation of the apparatus and process of the present invention. In the FIG. 2 embodiment the caulstock 11 is in the form of an endless belt which passes from separating roller 18 over rollers 28 and 30 and is reapplied to the web by roller 14. The FIG. 2 embodiment also shows and additional cooling roller 32.

While there has been described what is believed to be the preferred embodiments of the invention, those skilled in the art will recognize that other and further modifications may be made thereto without departing from the spirit of the invention, and it is intended to claim all such embodiments as fall within the true scope of the invention.

We claim:

1. In a process for curing solvent free ink, wherein resin powder is applied to a printed surface on a web and cured, the improvement wherein a caulstock laminate having a release agent is applied to said powdered, printed surface of said web, wherein said web and said caulstock are heated, wherein said web and said caulstock are pressed together, wherein said web and said caulstock are cooled, and wherein said caulstock is peeled from said web.

2. The improved process according to claim 1 wherein said heating step is carried out by passing said web and said caulstock over at least one heated roller.

3. The improved process according to claim 1 wherein said step of pressing said web and said caulstock together comprises pressing said web and said caulstock between a pair of rollers.

4. The improved process according to claim 1 wherein said release agent is a silicone release agent.

5. In a process for curing solvent free inks, wherein resin powder is applied to a printed surface on a web and cured, the improvement wherein a caulstock laminate having a release agent is applied to said powdered, printed surface of said web, wherein said web and said caulstock are passed over a first heated roller and pressed between said first roller and a second roller, wherein said web and said caulstock are passed over at least a third cooled roller, and wherein said caulstock is peeled from said web.

6. The improved process according to claim 5 wherein said step of applying a caulstock laminate comprises applying a caulstock laminate having an aluminum foil surface having a silicone release agent with said aluminum foil surface against said powdered, printed surface.

7. The improved process according to claim 5 wherein said step of applying a caulstock laminate comprises applying a caulstock laminate having a thermoset resin surface having a silicone release agent with said resin surface against said powdered printed surface.

8. The improved process according to claim 5 wherein said step of pressing said web and said caulstock between said first roller and a second roller comprises passing said web and said caulstock between said first roller and a second heated roller.

9. The improved process according to claim 5 including the further step of passing said web and said caulstock over a fourth cooled roller prior to peeling said caulstock.

10. The improved process according to claim 5 including the further step of returning said peeled caulstock laminate to be re-applied to said web surface.

11. The improved process according to claim 1 wherein said web has two powdered, printed surfaces, and wherein caulstock laminates are applied to both said surfaces.

* * * * *